US010280578B2

(12) United States Patent
Santha

(10) Patent No.: US 10,280,578 B2
(45) Date of Patent: May 7, 2019

(54) FIBER BLOCK SYSTEM

(71) Applicant: B. Lanka Santha, McDonough, GA (US)

(72) Inventor: B. Lanka Santha, McDonough, GA (US)

( * ) Notice: Subject to any disclaimer, the term of this patent is extended or adjusted under 35 U.S.C. 154(b) by 0 days.

(21) Appl. No.: 16/010,315

(22) Filed: Jun. 15, 2018

(65) Prior Publication Data

US 2019/0055706 A1 Feb. 21, 2019

Related U.S. Application Data

(60) Provisional application No. 62/605,648, filed on Aug. 21, 2017.

(51) Int. Cl.

| | |
|---|---|
| ***E02B 3/10*** | (2006.01) |
| ***E02D 17/20*** | (2006.01) |
| ***E02D 29/02*** | (2006.01) |

(52) U.S. Cl.

CPC ..... *E02B 3/106* (2013.01); *E02D 17/20* (2013.01); *E02D 29/0266* (2013.01); *E02D 2300/0051* (2013.01); *E02D 2600/30* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,973,355 | A | | 8/1976 | McKenzie |
| 4,434,576 | A | | 3/1984 | Sowerwine |
| 4,926,587 | A | | 5/1990 | van Wingerden |
| 4,960,349 | A | | 10/1990 | Willibey et al. |
| 5,091,247 | A | | 2/1992 | Willibey et al. |
| 5,161,917 | A | | 10/1992 | Papetti |
| 5,309,673 | A | | 5/1994 | Stover et al. |
| 5,338,131 | A | | 8/1994 | Bestmann |
| 5,421,123 | A | * | 6/1995 | Sakate ..... E02D 17/20 405/302.7 |
| 5,425,597 | A | | 6/1995 | Bestmann |
| 5,595,458 | A | | 1/1997 | Grabhorn |
| 5,605,416 | A | | 2/1997 | Roach |
| 5,641,244 | A | | 6/1997 | Bestmann |
| 5,651,641 | A | | 7/1997 | Stephens et al. |
| 5,658,096 | A | | 8/1997 | Von Kanel |
| 5,678,954 | A | | 10/1997 | Bestmann |
| 5,735,640 | A | | 4/1998 | Meyer et al. |
| 5,951,202 | A | | 9/1999 | Brown |
| 5,997,213 | A | | 12/1999 | Dennis et al. |
| 6,109,835 | A | | 8/2000 | Grabhorn |

(Continued)

FOREIGN PATENT DOCUMENTS

| | | | |
|---|---|---|---|
| EP | 0480890 | A1 | 4/1992 |
| JP | 359126824 | A | 7/1984 |

(Continued)

*Primary Examiner* — Kyle Armstrong
(74) *Attorney, Agent, or Firm* — Thomas B. McGurk

(57) ABSTRACT

A fiber block system suitable for controlling erosion and stabilizing soil is described that comprises a fiber block formed of a densely packed natural fibers and having an apron extending therefrom, wherein the apron is formed of the same natural fibers. The fiber block and apron are enclosed in a sleeve of fiber mesh and ties are disposed in the fiber block and connect to the sleeve. The fiber block, mesh, and ties can be made of coir fibers.

19 Claims, 18 Drawing Sheets

(56) References Cited

U.S. PATENT DOCUMENTS

| | | | | |
|---|---|---|---|---|
| 6,127,027 | A | 10/2000 | Nogami et al. | |
| 6,168,349 | B1 | 1/2001 | Perslow et al. | |
| 6,234,721 | B1 | 5/2001 | Cronkhite et al. | |
| 6,267,533 | B1 | 7/2001 | Bourg | |
| 6,547,493 | B2 | 4/2003 | Spangler et al. | |
| 6,616,383 | B2 | 9/2003 | Janz | |
| 6,709,202 | B2 | 3/2004 | Spangler et al. | |
| 6,893,193 | B2 | 5/2005 | Santha | |
| 7,029,208 | B1 | 4/2006 | Santha | |
| 8,740,503 | B1 | 6/2014 | Tyler | |
| 9,315,962 | B2 | 4/2016 | Santha | |
| 2002/0073616 | A1 | 6/2002 | Pelton | |
| 2003/0017000 | A1 | 1/2003 | Jansson | |
| 2003/0143026 | A1 | 7/2003 | Santha | |
| 2004/0005198 | A1 | 1/2004 | Spangler | |
| 2015/0240438 | A1* | 8/2015 | Santha | E02B 3/125 405/17 |

FOREIGN PATENT DOCUMENTS

| | | | |
|---|---|---|---|
| JP | 403055316 | A | 3/1991 |
| JP | 403233021 | A | 10/1991 |
| JP | 406212609 | A | 8/1994 |

* cited by examiner

FIBER BLOCK SYSTEM

CROSS REFERENCE TO RELATED APPLICATIONS

This application claims priority to U.S. Provisional Patent Application Ser. No. 62/605,648, entitled "Coconut Fiber Rectangular Wattle For Slope Length Shortening And Perimeter Sediment Control" filed Aug. 21, 2017 and which is hereby incorporated by reference in its entirety herein to provide continuity of disclosure.

BACKGROUND

Conventional forms of wattles and logs used for perimeter sediment control, slope length shortening, and check dam applications are generally circular in cross section. The circular structure results from the method of construction in which a tube of netting is stuffed with filler from one end. When installed, less than the entire diameter of the circular log will contact the ground due to its shape, resulting in performance issues that require additional installation steps to address. Water tends to flow between the ground and convention cylindrical wattles and logs since they lack sufficient contact and downward pressure to form adequate barriers to water flow. The additional installation steps that are sometimes taken with conventional wattles and logs can include the digging of trenches and the extensive use of ropes to anchor the circular wattles and logs in place. Use of anchoring ropes tends to result in water flowing between the circular log and the rope, thereby undercutting the log and at least partially defeating the purpose thereof. Furthermore, the performance efficiency per unit of weight of a conventional wattle log is not optimal due to the log being wider in diameter than the diameter of the portion thereof that actually contacts the ground.

Consequently, there is a need for a system that provides for perimeter sediment control, slope length shortening, and check dam applications that can address one or more of these and other shortcomings.

SUMMARY

The present disclosure encompasses a fiber block system for perimeter sediment control, slope length shortening, and/or check dam applications comprising, consisting of, or consisting essentially of: a fiber block comprising, consisting of, or consisting essentially of a top side, a bottom side opposing the top side, a front side connected to the top side, a rear side opposing the front side and extending between the top side and the bottom side, a right side, and a left side opposing the right side, wherein the fiber block comprises, consists of, or consists essentially of compressed natural fibers; a sleeve encasing the fiber block, wherein the sleeve comprises, consists of, or consists essentially of a natural fiber mesh; and, a plurality of ties extending through the fiber block, wherein each tie of the plurality of ties comprises, consists of, or consists essentially of a first end extending through one of the top side, the bottom side, the front side, and the rear side of the fiber block and a second end extending through another of the top side, the bottom side, the front side, and the rear side of the fiber block, wherein each tie of the plurality of ties connects to the sleeve at the first end and the second end of the tie, whereby the plurality of ties supports the fiber block, and wherein each tie of the plurality of ties comprises, consists of, or consists essentially of natural fibers.

In one aspect, the fiber block system can further comprise, consist of, or consist essentially of an apron projecting outward the front side of the fiber block, wherein the apron comprises, consists of, or consists essentially of an apron body comprising compressed natural fibers. In another aspect, the apron body can comprise, consist of, or consist essentially of an apron top side and an apron bottom side, and wherein the apron top side is aligned oblique to the apron bottom side. In a further aspect, the fiber block is integrally formed with the apron body. In yet another aspect, the apron body comprises, consists of, or consists essentially of an apron top side and an apron bottom side, and wherein the apron top side is aligned parallel to the apron bottom side. In still another aspect, the fiber block system can further comprise, consist of, or consist essentially of an apron tie extending through the apron body, wherein the apron body comprises, consists of, or consists essentially of an apron top side and an apron bottom side, wherein the apron tie extends from the apron top side and the apron bottom side, and wherein the apron tie connects to the sleeve above the apron top side and below the apron bottom side. In another aspect, the compressed natural fibers comprise, consist of, or consist essentially of coir fibers. In a further aspect, the plurality of ties comprises, consists of, or consists essentially of a standing tie extending through the top side and the bottom side of the fiber block and connected to the sleeve. In still a further aspect, the plurality of ties comprises, consists of, or consists essentially of a recumbent tie extending through the front side and the rear side of the fiber block and connected to the sleeve. In yet another aspect, the plurality of ties comprises, consists of, or consists essentially of a standing tie extending through the top side and the bottom side of the fiber block and connected to the sleeve, wherein the plurality of ties comprises, consists of, or consists essentially of a recumbent tie extending through the front side and the rear side of the fiber block and connected to the sleeve, and wherein the standing tie contacts the recumbent tie. In another aspect, a ratio of a rear side height of the fiber block to a top side width of the fiber block is greater than 2:1. In a further aspect, the fiber block system can further comprise, consist of, or consist essentially of an anchor tie attached to the sleeve. In yet another aspect, the fiber block system can further comprise, consist of, or consist essentially of a stake engaged with the anchor tie and aligned adjacent the fiber block.

The present disclosure also encompasses a fiber block system for perimeter sediment control, slope length shortening, and check dam applications comprising, consisting of, or consisting essentially of: a fiber block comprising, consisting of, or consisting essentially of a top side, a bottom side opposing the top side, a front side connected to the top side, a rear side opposing the front side and extending between and connected to the top side and the bottom side, a right side, and a left side opposing the right side, wherein the fiber block comprises, consists of, or consists essentially of compressed coir fibers; a sleeve encasing the fiber block, wherein sleeve comprises, consists of, or consists essentially of a mesh comprising, consists of, or consists essentially of coir fibers; and, a plurality of ties extending through the fiber block, wherein each tie of the plurality of ties extends through two opposing sides of the top side, bottom side, front side, rear side, left side, and right side of the fiber block and is connected to the sleeve adjacent each of the two sides through which the tie extends, whereby the plurality of ties supports the fiber block, and wherein each tie of the plurality of ties comprises, consists of, or consists essentially of coir fibers.

In one aspect, the fiber block system can further comprise, consist of, or consist essentially of an apron projecting outward the front side of the fiber block, wherein the apron comprises, consists of, or consists essentially of an apron body comprising, consisting of, or consisting essentially of an apron top side and an apron bottom side opposed to the apron top side, wherein the apron top side is connected to the front side of the fiber block, wherein the apron body is integrally formed with the fiber block, and wherein the apron body is encased in the sleeve and comprises, consists of, or consists essentially of compressed coir fibers. In another aspect, the apron top side is aligned parallel to the apron bottom side. In a further aspect, the apron top side is aligned oblique to the apron bottom side. In still another aspect, the fiber block system can further comprise, consist of, or consist essentially of an apron tie, wherein the apron tie extends from the apron top side and the apron bottom side, and wherein the apron tie connects to the sleeve above the apron top side and below the apron bottom side. In a further aspect, the plurality of ties comprises, consists or, consists essentially of a standing tie extending through the top side and the bottom side of the fiber block and connected to the sleeve. In another aspect, the plurality of ties can comprise, consist of, or consist essentially of a recumbent tie extending the front side and the rear side of the fiber block and connected to the sleeve. In still a further aspect, the plurality of ties can comprise, consist of, or consist essentially of a standing tie extending through the top side and the bottom side of the fiber block and connected to the sleeve, wherein the plurality of ties comprises, consists of, or consists essentially of a recumbent tie extending through the front side and the rear side of the fiber block and connected to the sleeve, and wherein the standing tie contacts the recumbent tie.

The present disclosure also encompasses a fiber block system for perimeter sediment control, slope length shortening, and check dam applications comprising, consisting of, or consisting essentially of: a fiber block comprising, consisting of, or consisting essentially of a top side, a bottom side opposing the top side, a front side connected to the top side, a rear side opposing the front side and extending between and connected to the top side and the bottom side, a right side, and a left side opposing the right side, wherein the fiber block comprises, consists of, or consists essentially of compressed coir fibers; a sleeve encasing the fiber block, wherein the sleeve comprises, consists of, or consists essentially of coir fiber mesh; and, a plurality of ties extending through the fiber block, wherein the plurality of ties comprises, consists of, or consists essentially of a standing tie extending through the top side and the bottom side of the fiber block, wherein the standing tie is connected to the sleeve adjacent the top side and the bottom side of the fiber block, wherein the plurality of ties comprises, consists of, or consists essentially of a recumbent tie extending through the front side and the rear side of the fiber block, wherein the recumbent tie is connected to the sleeve adjacent the front side and the rear side of the fiber block, whereby the plurality of ties supports the fiber block, and wherein each standing tie and each recumbent tie comprises, consists of, or consists essentially of coir fibers.

In one aspect, the fiber block system can further comprise, consist of, or consist essentially of an apron projecting outward the front side of the fiber block, wherein the apron comprises an apron body comprising, consisting of, or consisting essentially of an apron top side and an apron bottom side opposed to the apron top side, wherein the apron top side is connected to the front side of the fiber block, wherein the fiber block is integrally formed with the apron body, and wherein the apron body comprises, consists of, or consists essentially of the compressed coir fibers. In another aspect, the fiber block system can further comprise, consist of, or consist essentially of an apron tie comprising, consisting of, or consisting essentially of coir fibers, wherein the apron tie extends from the apron top side and the apron bottom side, and wherein the apron tie connects to the sleeve adjacent the apron top side and the apron bottom side.

These and other aspects of the present disclosure are set forth in greater detail below and in the drawings for which a brief description is provided as follows.

11 with stakes aligned adjacent the front side and the back side of the fiber block system segment and staples inserted in the fiber block.

Figure 11:
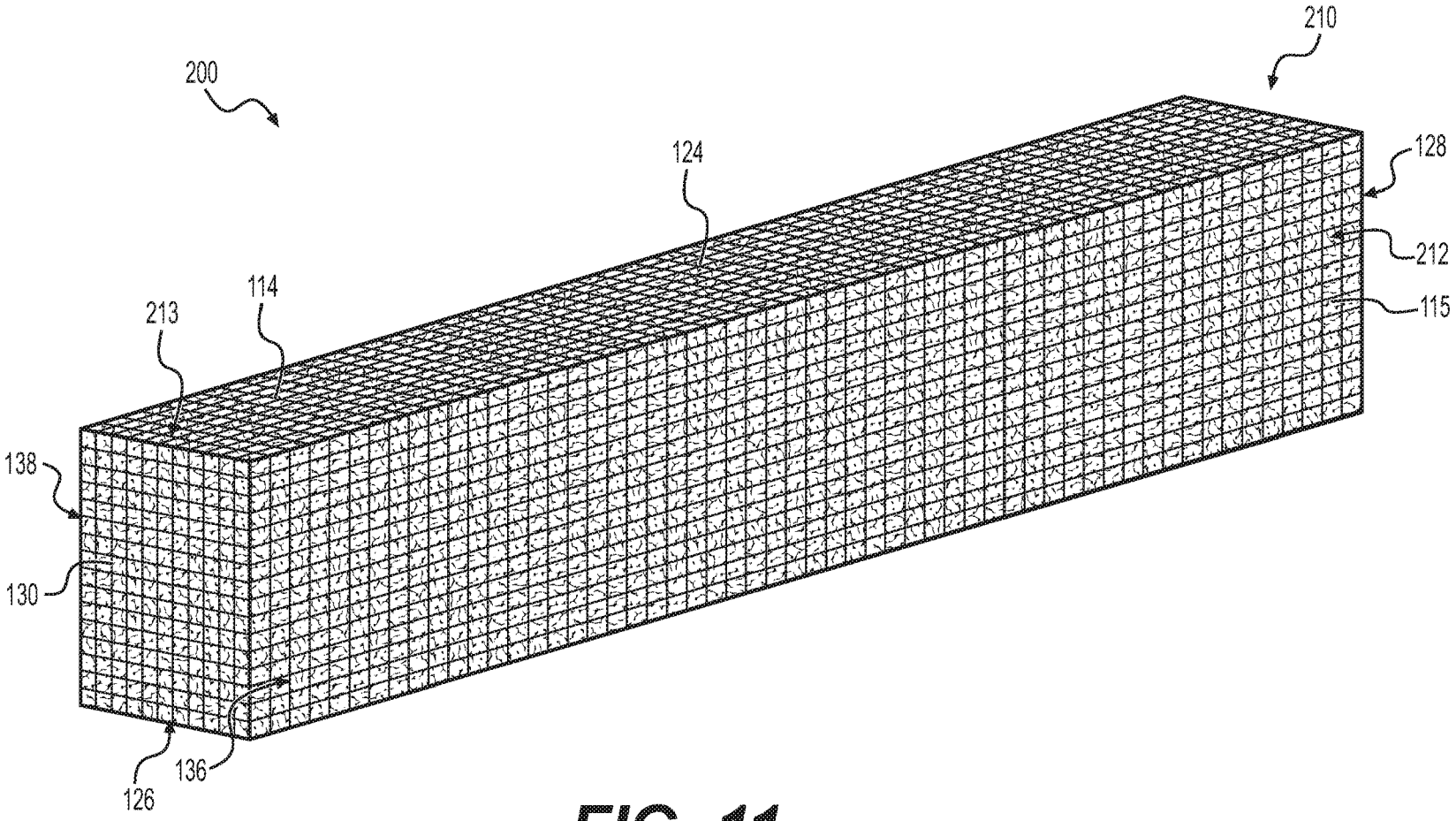
FIG. 11 is a perspective view of another fiber block system segment encompassing aspects of the present disclosure.
Figure 15:
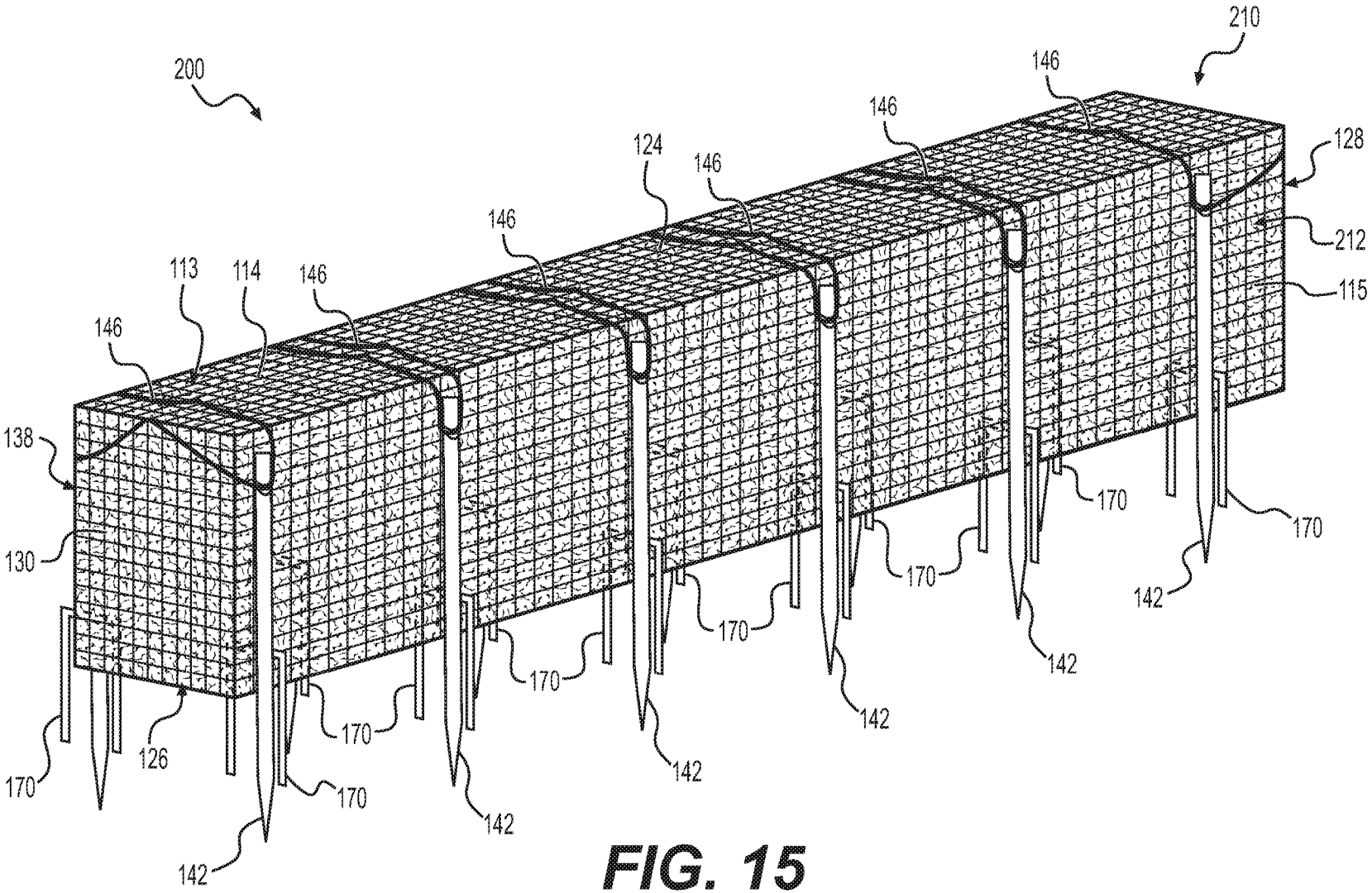

FIG. 15 is a perspective view of a portion of yet another fiber block system comprising the fiber block system segment of FIG. 11 with an alternatively configured stakes aligned adjacent the front side and the back side of the fiber block system segment.

Figure 14:
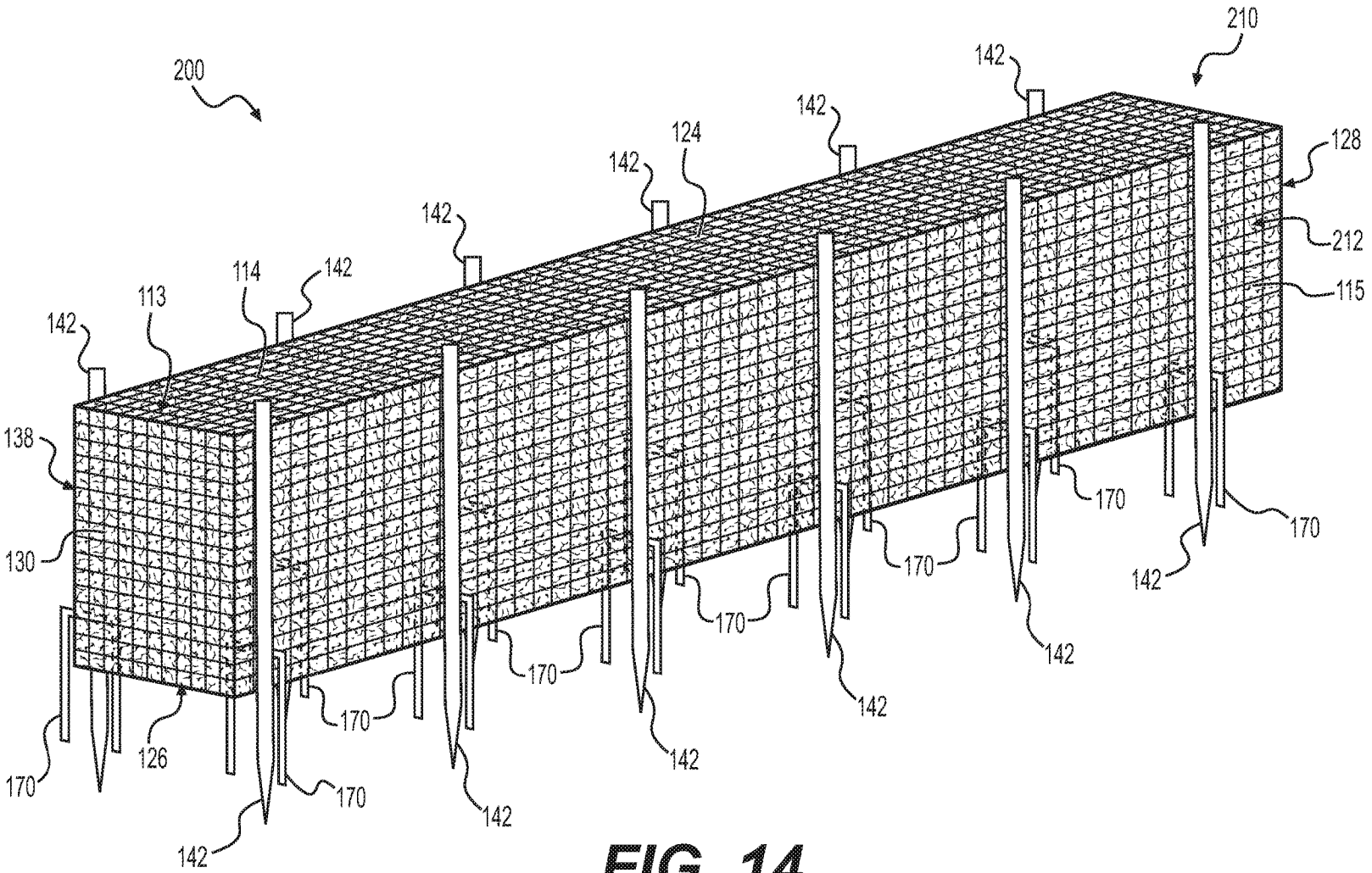
FIG. 14 is a perspective view of a portion of a fiber block system comprising the fiber block system segment of FIG.
Figure 16:
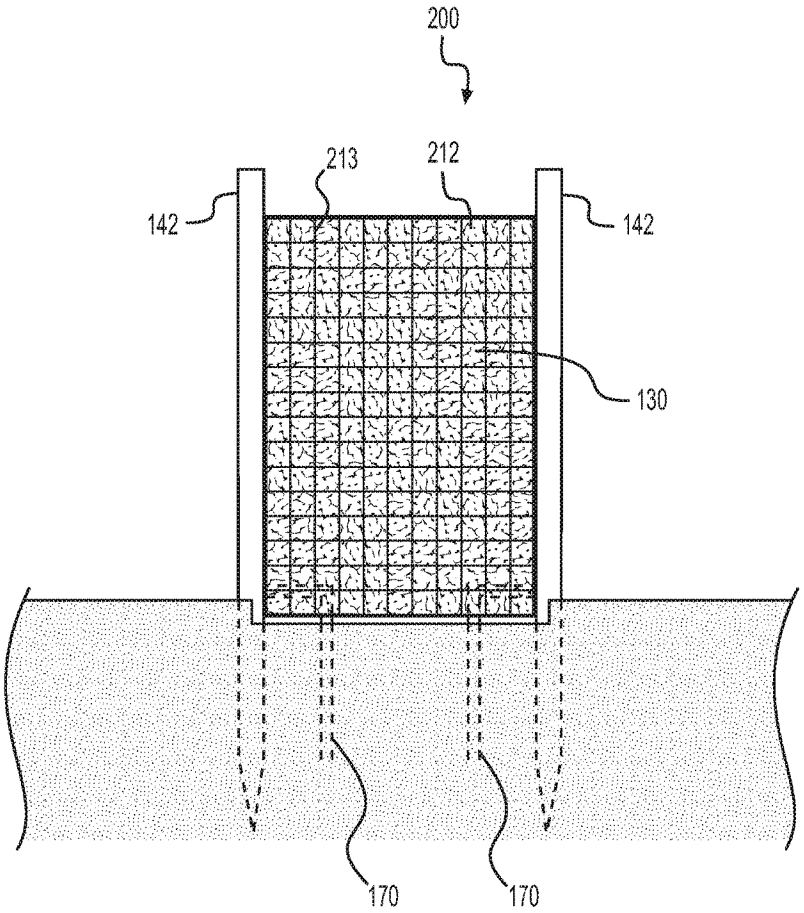

FIG. 16 is an end view of the portion of the fiber block system of FIG. 14 installed in a trench formed in soil.

Figure 17:
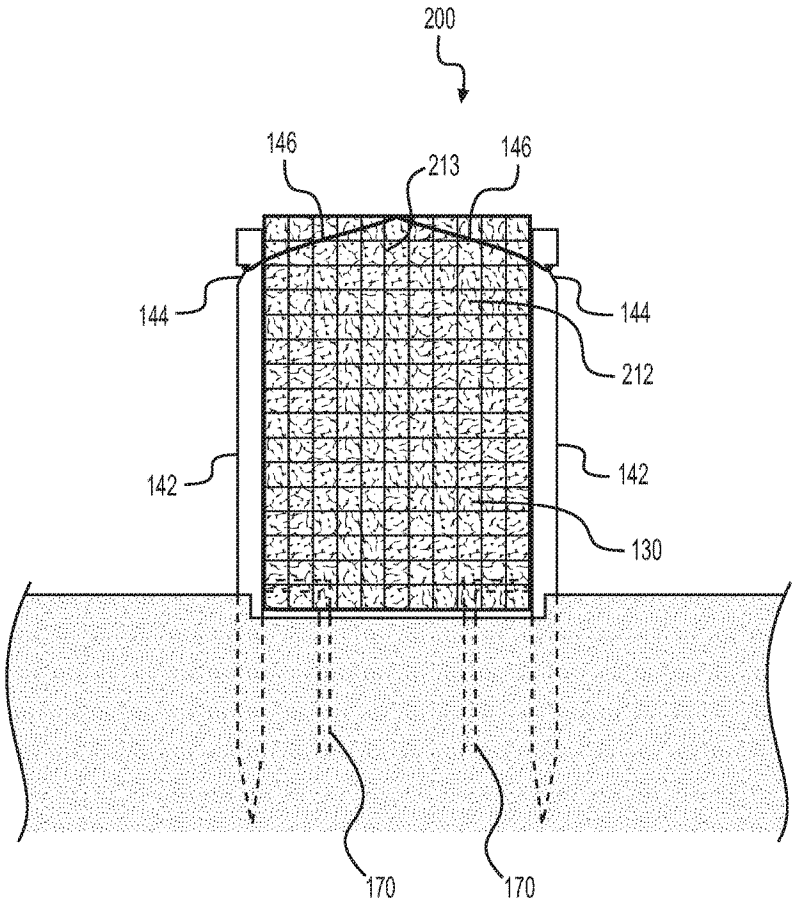

FIG. 17 is an end view of the portion of the fiber block system of FIG. 15 installed in a trench formed in soil.

DETAILED DESCRIPTION

The present disclosure encompasses fiber block systems and fiber block system segments that can be used in applications for erosion and sediment control, perimeter sediment control, slope length shortening, and/or check dam formation. The present disclosure refers in detail below to various aspects of fiber block systems and fiber block system segments, which are illustrated in the accompanying drawings. Wherever possible, the application uses the same reference numbers throughout the drawings to refer to the same or similar items.

As used herein, the singular forms of "a," "an," and "the" encompass the plural forms thereof unless otherwise indicated. As used herein, the phrase "at least one" includes all numbers of one and greater. As used herein, the term "and/or" refers to one or all of the listed elements or a combination of any two or more of the listed elements. As used herein, the phrase "integrally formed" means formed as a single, unitary body. As used herein, the term "oblique" refers to the alignment of one part to another part, wherein the alignment is neither parallel nor perpendicular.

The fiber block systems and fiber block system segments encompassed by the present disclosure can comprise natural materials that are ecologically friendly and that can aid in erosion and sediment control, perimeter sediment control, slope length shortening, and/or check dam applications. Because the fiber block systems and fiber block system segments comprise natural materials and can aid in controlling erosion, it can be installed in environmentally sensitive areas. The fiber block systems encompassed by the present disclosure can comprise one or more fiber block system segments as described herein aligned alone, end to end with other fiber block system segments, and/or side by side with other fiber block system segments to provide a barrier of sufficient length and width to achieve the intended goals. The fiber block systems and fiber block system segments can aid in the protection of bare soil disposed adjacent to them from erosion. Among the natural materials that can be used in the fiber blocks, sleeves, meshes, and ties of the fiber block systems is coconut or coir fiber, which can be used to form any one or more of these components and provide the desired characteristics of the systems.

Figure 1:
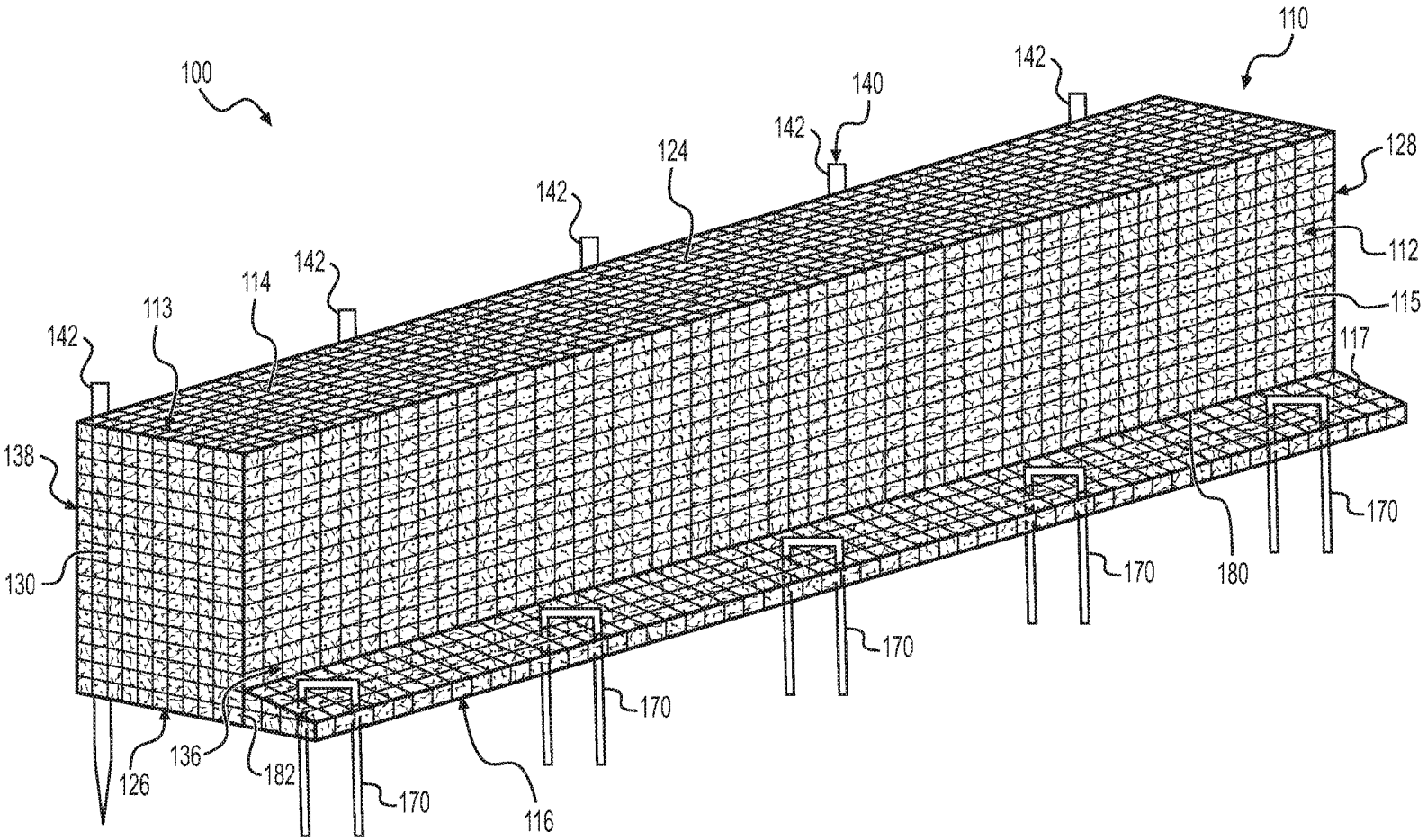
FIG. 1 is a perspective view of a portion of a fiber block system including a fiber block system segment of the fiber block system, wherein the fiber block system and the fiber block system segment encompass aspects of the present disclosure.

FIGS. 1-9 illustrate a portion of a fiber block system 100 and a fiber block segment 110, and alternative parts thereof, encompassing aspects of the present disclosure. As shown in FIG. 1, the fiber block system segment 110 of the fiber block system 100 comprises a fiber block 112 formed of compressed coir fibers 115 encased in a sleeve 113 of a high strength mesh 114. The mesh 114 can comprise natural fibers, such as coir fibers, other biodegradable fibers, or synthetic fibers, or of twine made with biodegradable fibers wrapped around a synthetic core. In one aspect, both the fiber block 112 and the mesh 114 consist essentially of coir fibers.

The fiber block 112 comprises an elongated portion that is rectangular in cross-section. The fiber block 112 comprises a top side 124, a bottom side 126 opposite the top side 124, a front side 136, a rear side 138 opposite the front side 136, a left side 130 and a right side 128 opposing the left side 130. The top side 124 and the rear side 138 are generally rectangular. The top portion of the front side 136 is also generally rectangular. The top side 124, the front side 136, the rear side 138, and the bottom side 126 are generally flat and extend the length of the fiber block 112 between the left side 130 and the right side 128.

Figure 4A:
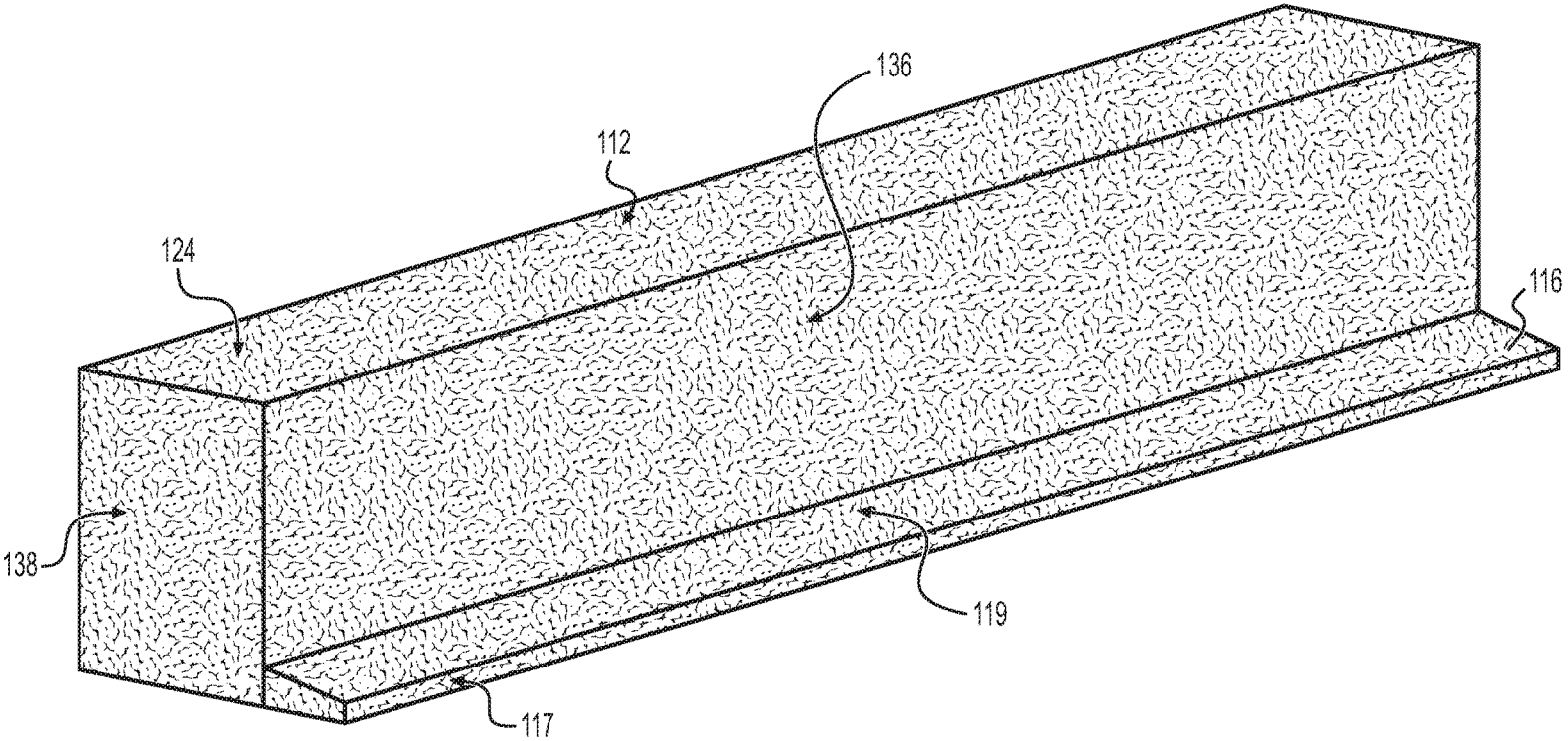
FIG. 4A is a perspective view of the fiber block of the fiber block system segment shown in FIG. 1 with the sleeve of mesh, stakes, and staples removed.
Figure 4B:
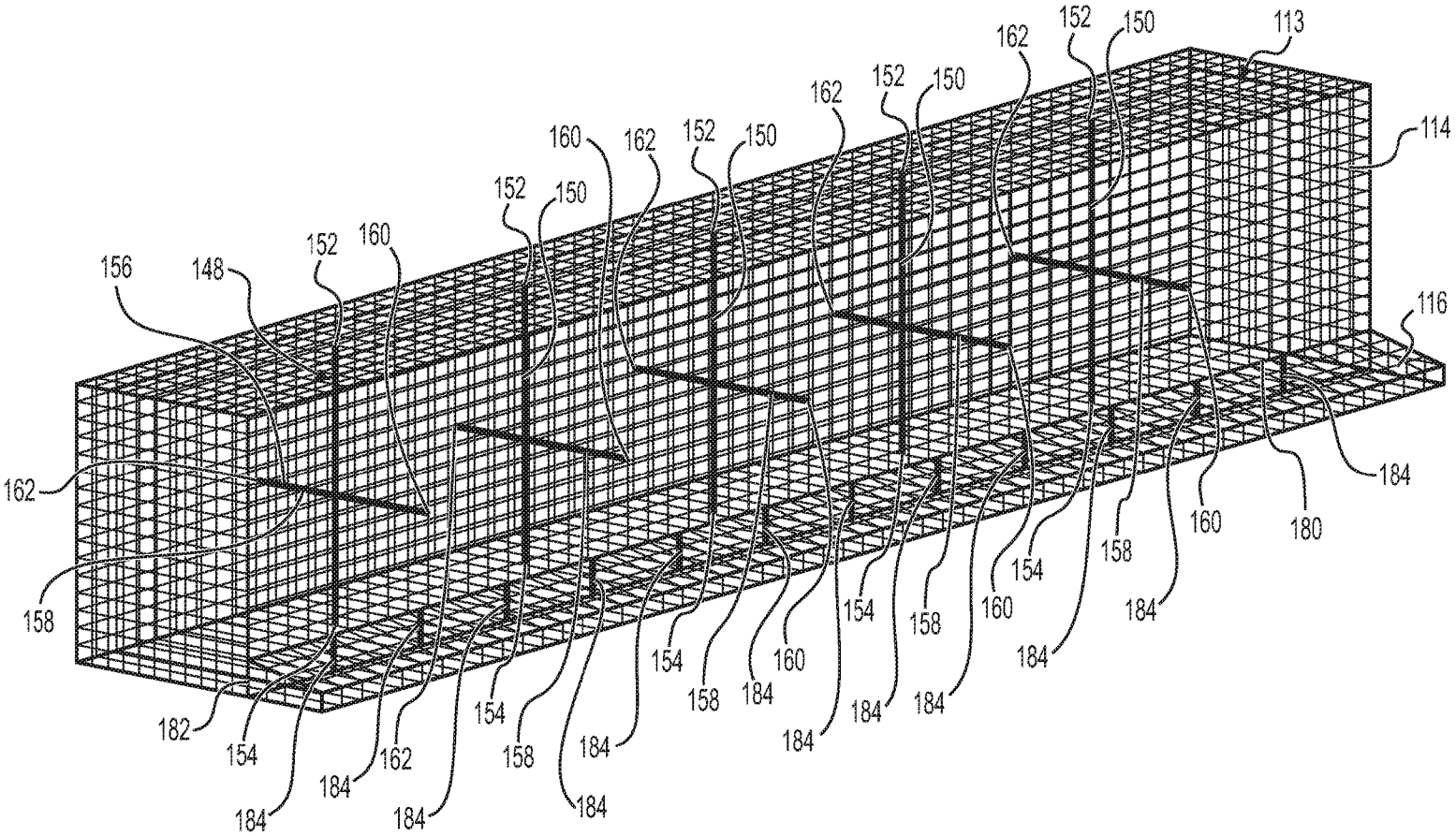
FIG. 4B is a perspective view of the sleeve of mesh of the fiber block system segment shown in FIG. 1 with the fiber block, stakes, and staples removed.
Figure 5:
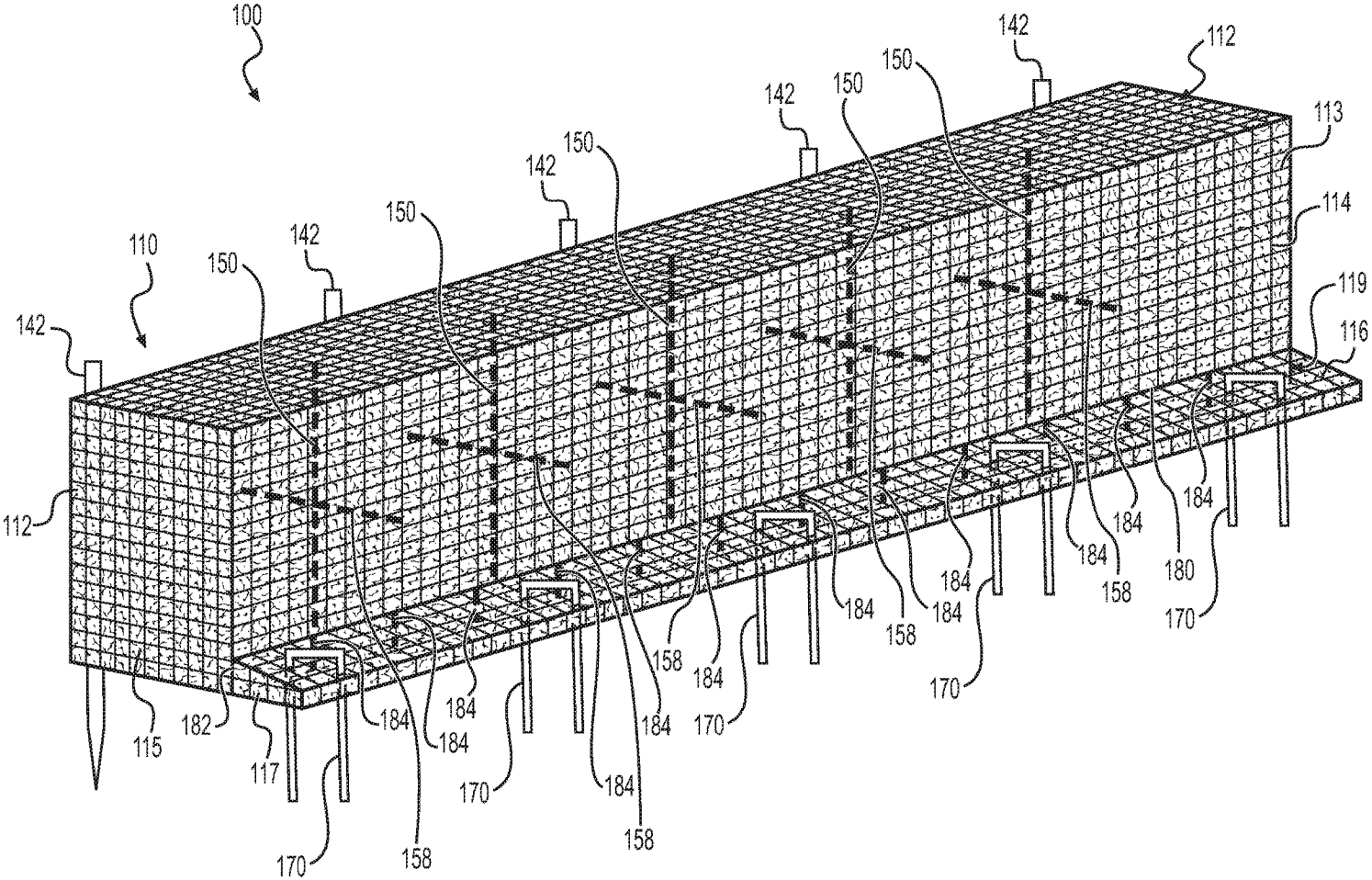
FIG. 5 is a perspective view of the portion of the fiber block system shown in FIG. 1 with the ties that are disposed internally in and extend through the fiber block highlighted in dashed line.
Figure 6:
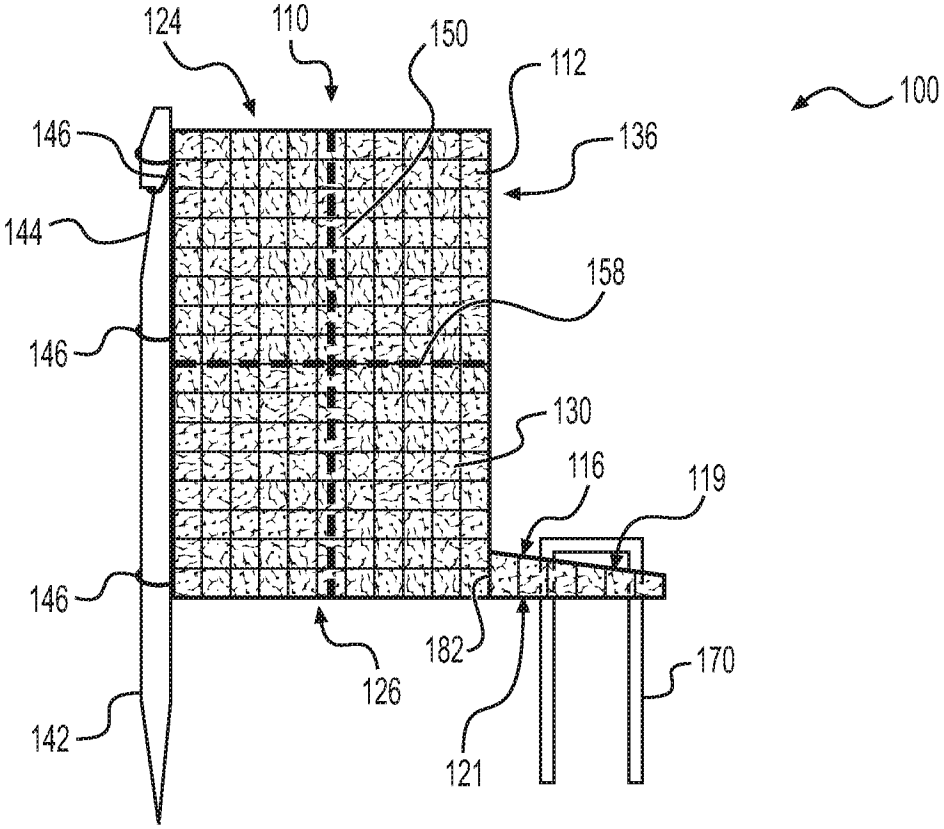
FIG. 6 is a side view of the portion of the fiber block system shown in FIG. 5 with the ties that are disposed in and extend through the fiber block highlighted in dashed line.

An apron 116 projects outward from the front side 136 of the fiber block 112 and aids in anchoring the fiber block system segment 110 in place when installed. The apron 116 comprises an apron body 117 on which is formed an apron top side 119. The apron body 117 is aligned at a lower portion of the front side 136. The apron top side 119 is aligned generally oblique to the bottom side 126 of the fiber block 112 such that the apron top side 119 is not parallel or perpendicular to the bottom side 126. The apron top side 119 is generally flat and rectangular and forms an inclined surface extending downward from the front side 136. As shown in FIG. 4A, the apron body 117 is integrally formed with the fiber block 112 such that the fiber block 112 and the apron body 117 constitute a single unitary body formed of compressed coir fibers. In one aspect, the fiber block 112 and the apron body 117 consist essentially of compressed coir fibers. In another aspect, the apron 116 extends the entire length of the fiber block 112 between the left side 130 and the right side 128.

Figure 2:
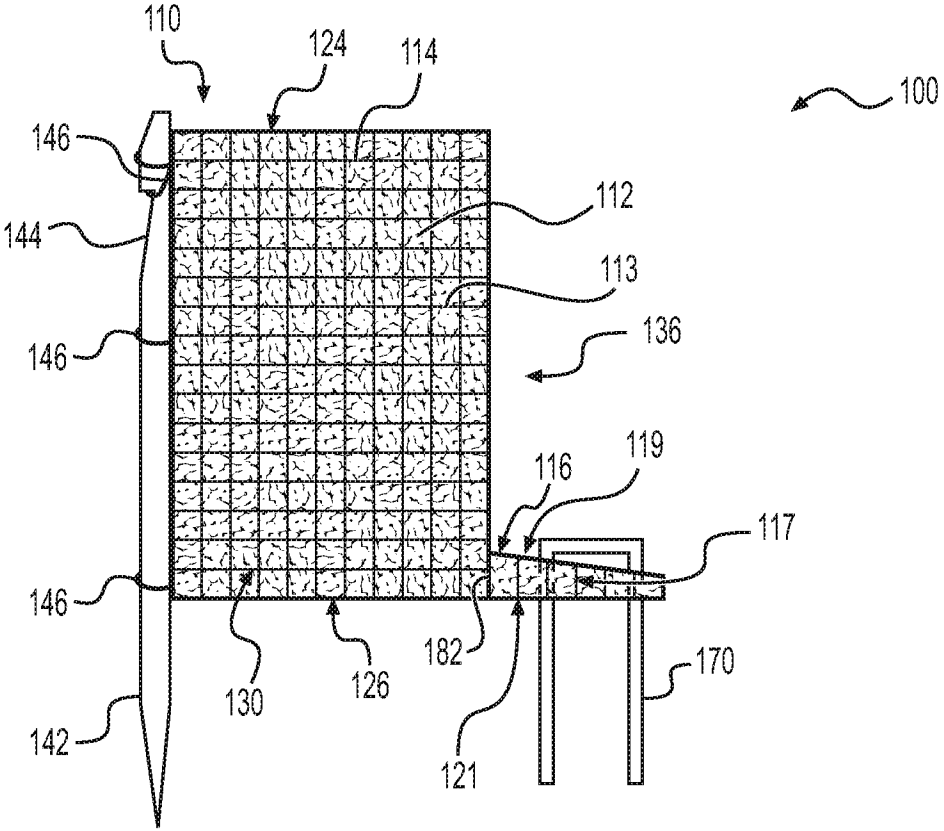
FIG. 2 is a side view of the portion of the fiber block system shown in FIG. 1.
Figure 3:
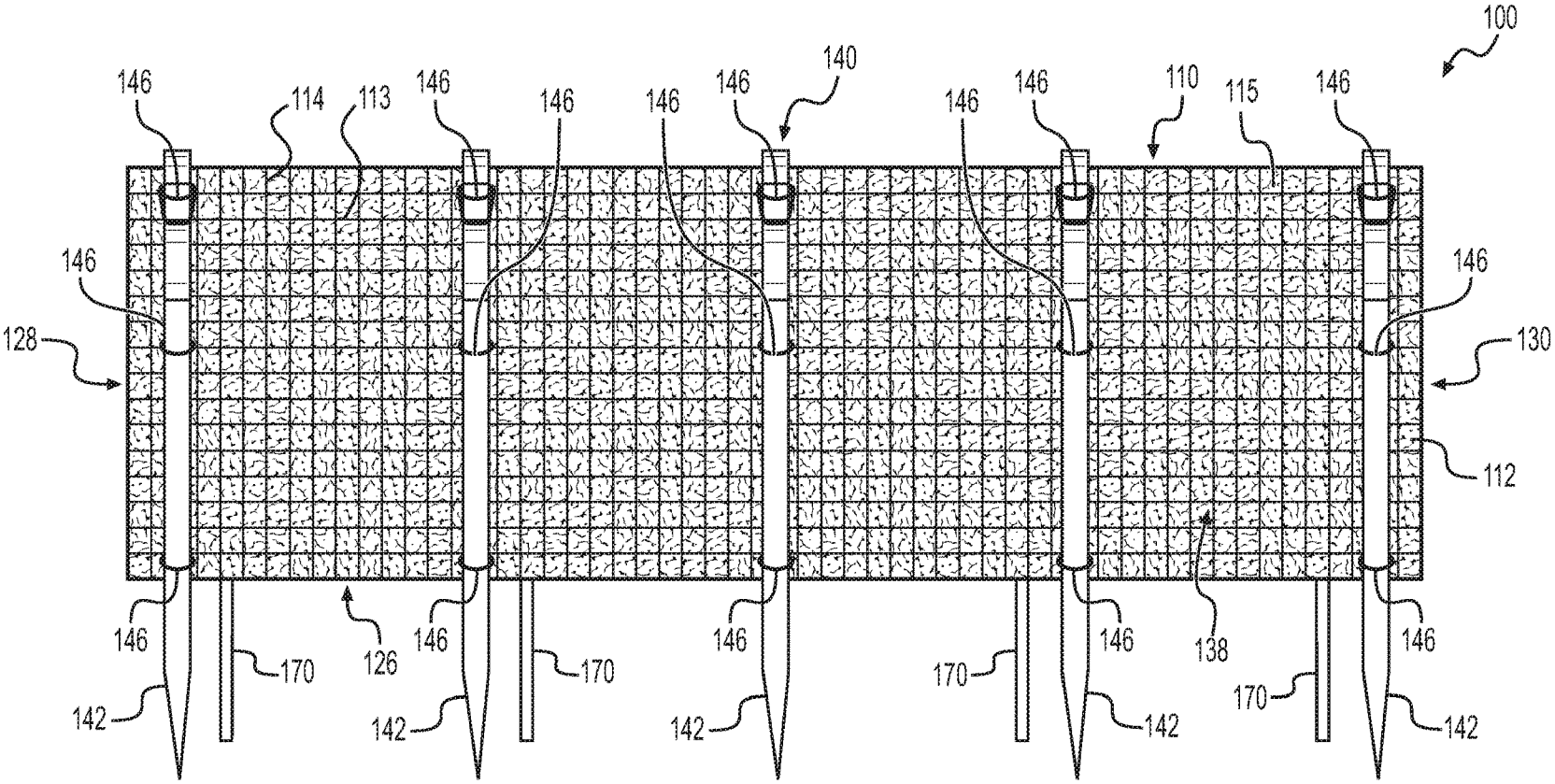
FIG. 3 is rear view of the portion of the fiber block system shown in FIG. 1.

As shown in FIGS. 1-3, the fiber block 112 and the apron 116 of the fiber block system segment 110 are completely encased in a sleeve 113 formed of a mesh 114. The mesh 114 of the sleeve 113 covers the top side 124, the front side 136, the rear side 138, the bottom side 126, the left side 130, and the right side 138 of the fiber block 112, as well as the entire apron body 117. One or more staples 170 can be inserted into the sleeve 113 and the apron 116 to anchor the apron 116 to the ground on which the fiber block segment 110 is positioned during installation.

As shown in FIGS. 1-3, the fiber block system 100 can comprise a plurality of stakes 140 positioned adjacent the rear side 138 of the fiber block 112. Each stake 142 of the plurality of stakes 140 can be connected to the fiber block 112 by one or more anchor ties 146 that loop around each stake 142. The anchor ties 146 are attached to and/or integrally formed with the sleeve 113 and can be formed of the same coir fiber twine of which the mesh 114 of the sleeve 113 is formed. Each stake 142 can include a notch 144 formed therein through which an anchor tie 146 can be threaded. The fiber block system segment 110 can be firmly positioned in place by securely cinching an anchor tie 146 through each notch 144. Each stake 142 can be positioned directly adjacent to the rear side 138 and spaced apart from the other stakes 142 so as to provide support system for the fiber block segment 110 across the length of the fiber block 112. As each stake 142 is driven into the ground, the anchor tie 146 that is engaged with the notch 144 of the stake 142 is pulled downward by the stake 142, thereby pulling the sleeve 113 and the fiber block 112 downward with the anchor tie 146 to secure the fiber block segment 110 to the ground.

FIGS. 4B-6 illustrate a plurality of ties 148 disposed in the sleeve 113 and attach to the mesh 114 at two different points.

Each tie of the plurality of ties 148 extends through the fiber block 112 and outward from two sides of the fiber block 112, connecting to the sleeve 113 at each end thereof. One or more apron ties 184 extend through the apron body 117 and connect to the sleeve 113 above the apron top side 119 and below the apron bottom side 121.

Each tie of the plurality of ties 148 can be either a standing tie 150 that extends outward from the top side 124 and the bottom side 126 of the fiber block 112 or a recumbent tie 158 that extends outward through the front side 136 and the rear side 138 the fiber block 112. Each standing tie 150 and each recumbent tie 158 of the plurality of ties 148 extends through two opposing sides of the fiber block 112 and is attached to the sleeve 113. Each standing tie 150 comprises a first end 152 that extends through the top side 124 of the fiber block 112 and is attached to the sleeve 113 at the top side 124 of the fiber block 112 and a second end 154 that extends through the bottom side 126 of the fiber block 112 and is attached to the sleeve 113 at the bottom side 126 of the fiber block 112. Each recumbent tie 158 comprises a first end 160 that extends through the front side 136 of the fiber block 112 and is attached to the sleeve 113 at the front side 136 of the fiber block 112 and a second end 162 that extends through the rear side 138 of the fiber block 112 and is attached to the sleeve 113 at the rear side 138 of the fiber block 112. The plurality of ties 148 helps to maintain the rectangular shape and integrity of the fiber block system segment 110 preventing the sleeve 113 from bulging outward. The sleeve 113, in turn, tends to keep inward pressure on the sides of the fiber block 112 so as to aid it in maintaining its rectangular shape. A majority of the length of each tie of the plurality of ties 148 is encased in the compressed coir fibers of the fiber block 112 with only the first and second ends of each tie extending outward from the sides of the fiber block 112. Each standing tie 150 can contact and/or be intertwined with a recumbent tie 158 to further aid in maintaining the strength and form of the fiber block 112. Some of the ties of the plurality of ties 148 can be stitched or otherwise connected to the outer sides of the fiber block 112 and also to the sleeve 113 to reinforce the shape and integrity of the fiber block segment 110. In one aspect, the standing ties 150 can be aligned generally vertically and the recumbent ties 158 can be aligned generally horizontally in the fiber block 112. In another aspect, the standing ties 150 and/or the recumbent ties 158 can be aligned oblique to one or more sides of the fiber block 112.

Each apron tie 184 extends through the apron body 117 adjacent to the area from whence the apron body 117 projects from the rest of the fiber block 112. Each apron tie 184 connects at one end to the sleeve 113 above the apron top side 119 adjacent the first side 136 of the fiber block 112 and at another end to the sleeve 113 below the apron bottom side 121. The apron ties 184 help to maintain the shape and integrity of the apron 116 after it has been formed. A cross tie 180 is attached to the sleeve 113 and extends from the left side 138 to the right side 128 and is aligned in the area where the front side 136 of the fiber block 112 meets the apron top side 119 of the apron body 117. Any one or more of the apron ties 184 can be attached to the cross tie 180. Side apron ties 182 can be attached to the ends of the cross tie 180 and the sleeve 113 and be aligned on the left and right sides 138 and 128 of the fiber block 112 approximately where the apron body 117 meets the fiber block 112. The side apron ties 182 are approximately the same length and have the same alignment as the apron ties 184. The cross tie 180, the apron ties 184, and the side apron ties 182 can be formed of natural fiber twine, such as coir fiber twine, and are provided to help maintain the shape and integrity of the fiber block segment 110. The cross tie 180, the side apron ties 182, and the apron ties 184 can be stitched on the sleeve 113 and/or into and/or on the apron body 117 and/or the fiber block 112 or inserted through the apron body 117 and/or the fiber block 112 and attached at the ends thereof to the sleeve 113.

The fiber block 112 can have a height twice as long as or greater than the width of the rectangular portion thereof. In one aspect, the rear side 138 of the fiber block 112 can be about 23 cm in height and the top side 124 can be about 10 cm in width. In another aspect, the rear side 138 of the fiber block 112 can be about 30 cm in height and the top side 124 can be about 15 cm in width. In yet another aspect, the rear side 138 of the fiber block 112 can be about 45 cm in height and the top side 124 can be about 20 cm in width. In a further aspect, the ratio of the rear side height of the fiber block 112 to the top side width can be about 2:1.

Figure 7:
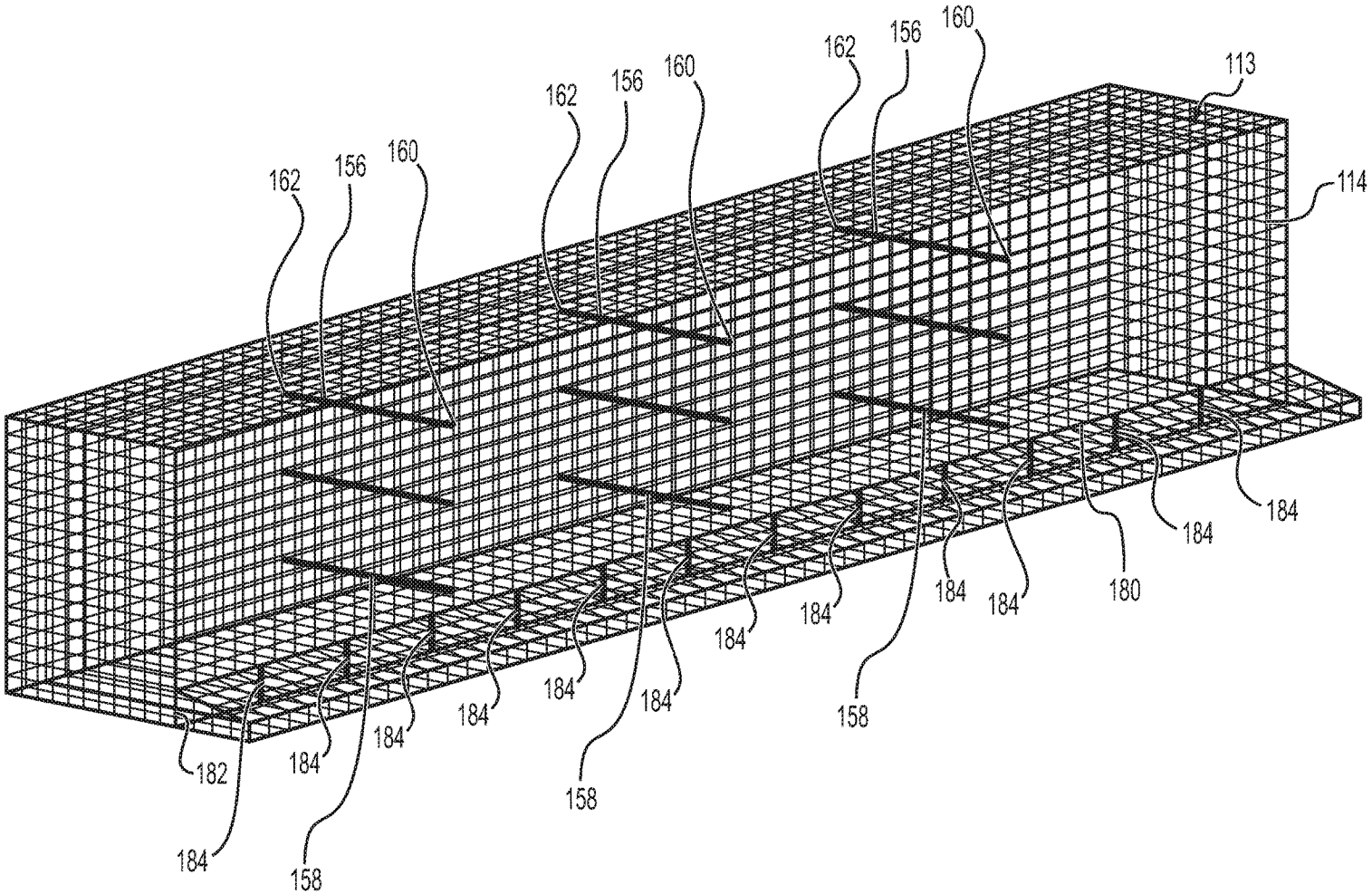
FIG. 7 is perspective view of an alternative sleeve and tie arrangement of the fiber block systems and fiber block system segments encompassed by the present disclosure with an alternative number and configuration of ties that are disposed in and extend through a fiber block, not shown, of a fiber block system segment.

FIG. 7 illustrates an alternative configuration of ties that be used in the fiber block system segments encompassed by the present disclosure. In FIG. 7, the configuration of ties comprises only recumbent ties 158 connected to the sleeve 113 and which can be disposed in the fiber block system segment 110. Three planar groups 156 of recumbent ties 158 are connected to the sleeve 113 and extend through the fiber block 112, not shown. Each of the three planar groups 156 comprises three recumbent ties 158 spaced apart from and parallel to each other. Each recumbent tie 158 is attached to the sleeve 113 at both a first end 160 and a second end 162.

Figure 8:
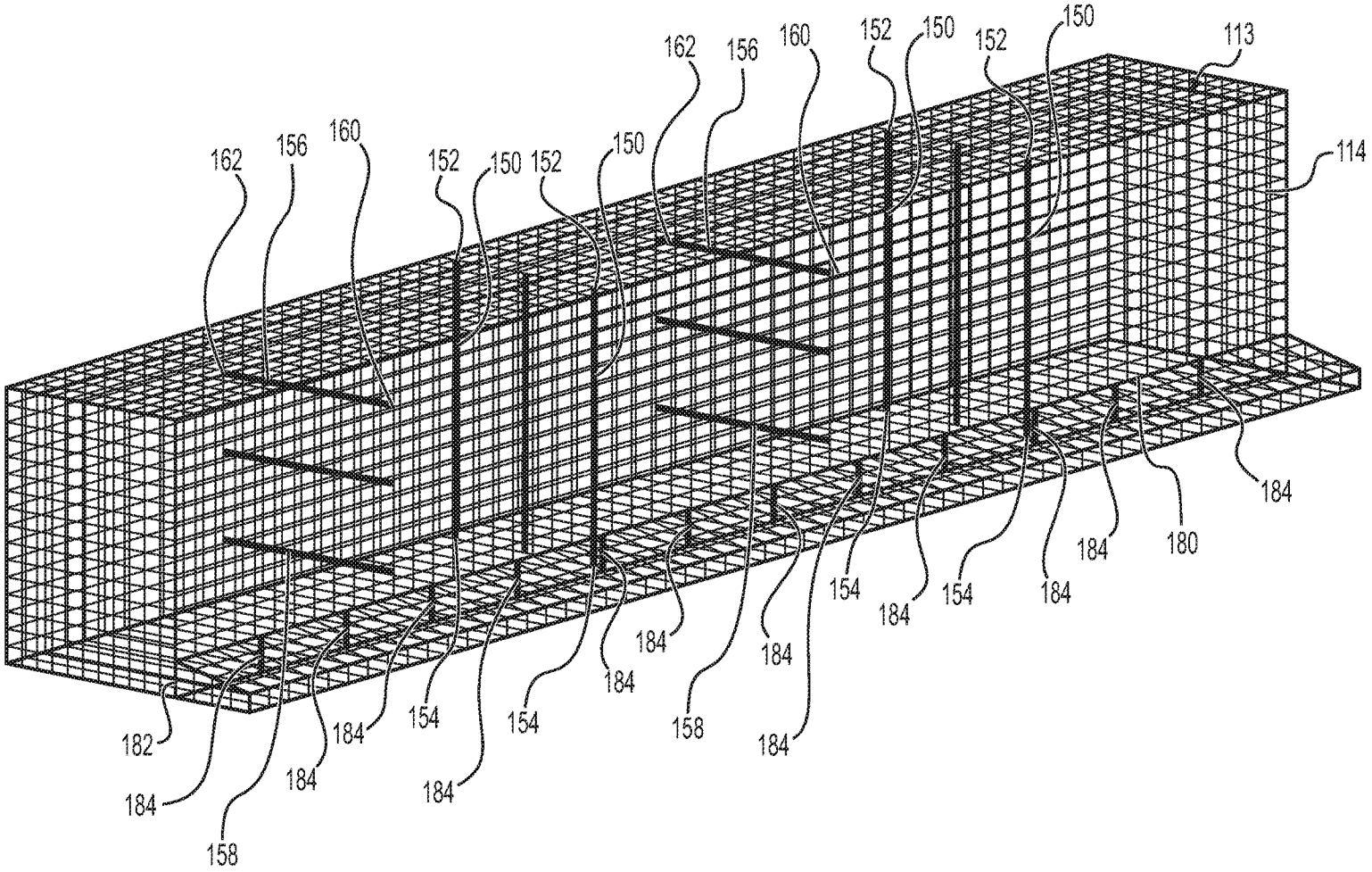
FIG. 8 is perspective view of yet another sleeve and tie arrangement of the fiber block systems and fiber block system segments encompassed by the present disclosure with another alternative configuration of ties that are disposed in and extend through a fiber block of a fiber block system segment.

FIG. 8 illustrates yet another alternative configuration of ties that can be included in the fiber block system segments encompassed by the present disclosure. FIG. 8 shows the sleeve 113 without the fiber block 112 and four groups of ties disposed in and connected to the sleeve 113. Two planar groups 156 of recumbent ties 158 are provided with a two groups with three standing ties 150 each. Each of the recumbent and standing ties 158 and 150 are connected at a first end to one side of the sleeve 113 and at a second end to an opposing side of the sleeve 113. In one aspect, each recumbent tie 158 and each standing tie 150 can consist essentially of coir fibers.

Figure 9:
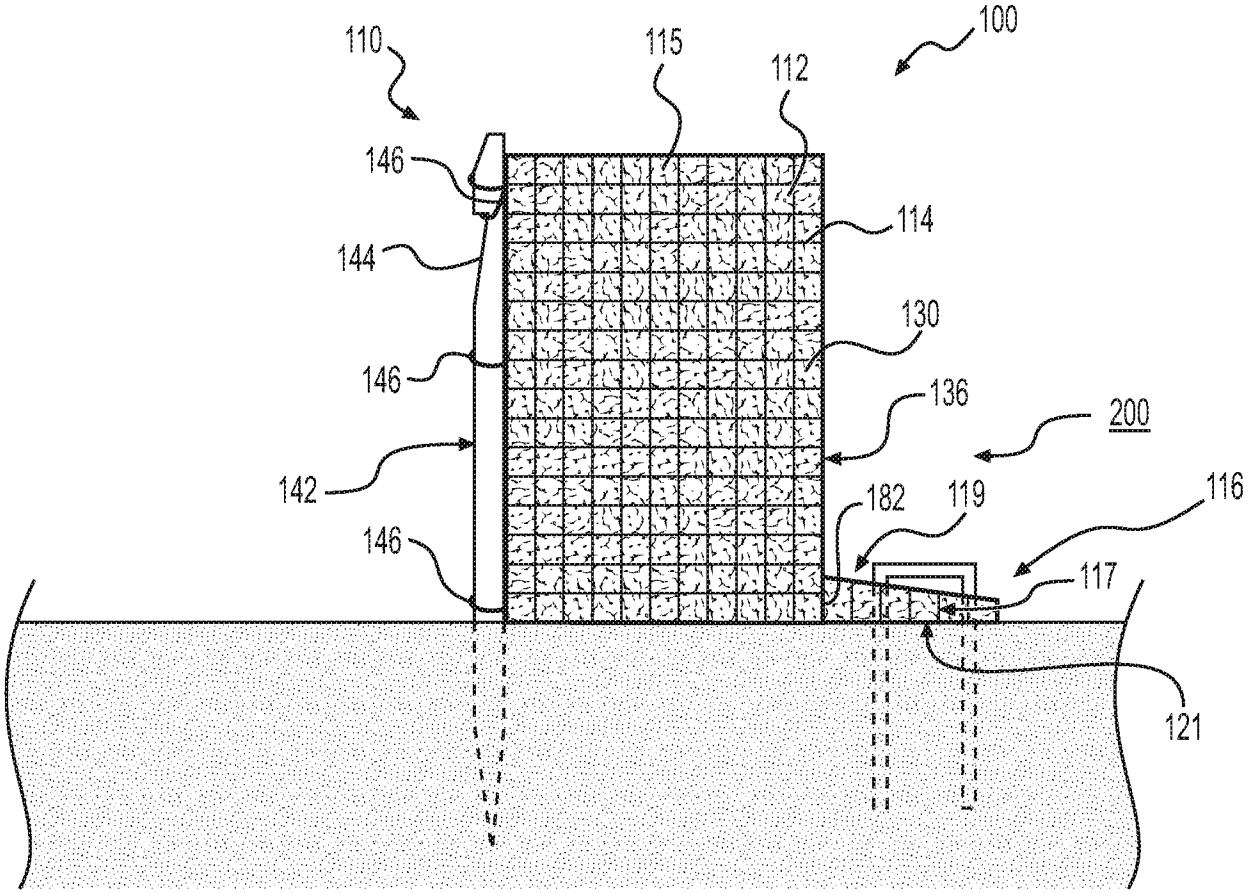
FIG. 9 is a side view of the portion of the fiber block system of FIG. 1 installed on soil.

FIG. 9 illustrates the fiber block system 100 in use as installed in soil aligned perpendicular to a water flow 200. The front side 136 of the fiber block 112 is installed facing towards the water flow 200 with the apron 116 extending outward from the front side 136 towards the water flow 200 and resting on the ground. Each stake 142 is inserted in the soil of the ground to secure the fiber block system 100 in place. The anchor ties 146 attach to the mesh 114 of the sleeve 113 and secure the stakes 142 to the fiber block 112. Staples are inserted through the apron top side 119 down through the apron body 117 and into the ground below. When water flows 200 towards the front side 136 of the fiber block 112 silt that is carried by the water flow 200 tends to contact and be stopped by the fiber block system 100, thereby preventing silt to pass beyond the fiber block system 100. Silt will tend to accumulate on the front side 136 of the fiber block and the apron top side 119 of the apron, thereby providing additional downward force on the fiber block system 100 to hold it in place. Multiple fiber block segments 110 can be installed end to end to provide a continue barrier to prevent silt movement or erosion.

Figure 10:
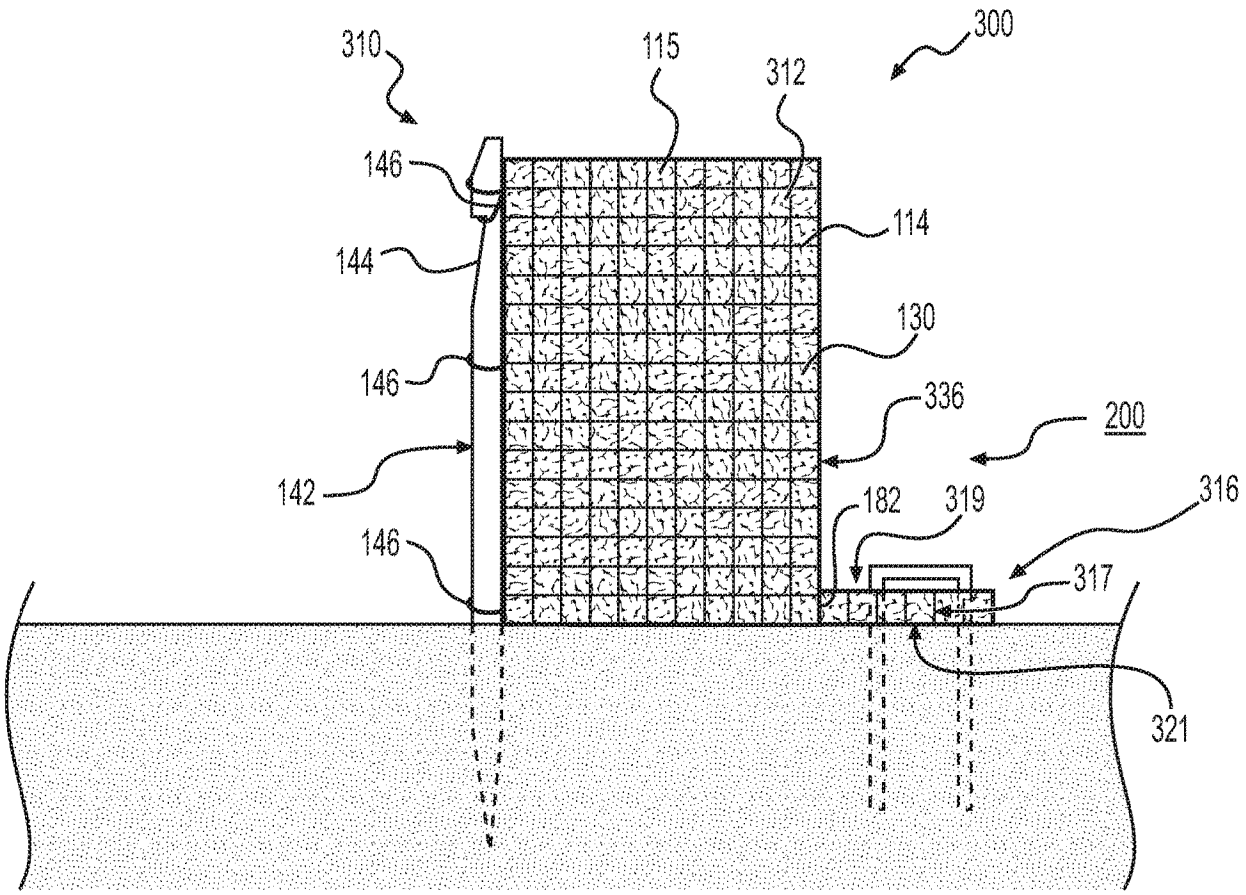
FIG. 10 is a side view of a portion of another fiber block system encompassing aspects of the present disclosure installed on soil with the fiber block system comprising an alternative fiber block system segment with an alternatively configured apron.

FIG. 10 illustrates a fiber block segment 310 of a fiber block system 300 encompassing aspects of the present disclosure. The fiber block system segment 310 comprises a fiber block body 312 comprising natural fibers formed into a rectangular shape. An apron 316 projects from the front side 336 of the fiber block body 312. The apron 316 comprises an apron body 317 that is integrally formed with the fiber block body 312 and comprises the same natural fibers. The fiber block body 317 comprises an apron top side 319 and an apron bottom side 321, wherein the apron top side 319 is aligned parallel to the apron bottom side 321 and perpendicular to the front side 336 of the fiber block body 312. The fiber block body 312 and the apron body 317 are both encased in a mesh 114. The apron 316 can be anchored in place using staples or stakes inserted through the apron 316 into the ground. The apron 316 can be aligned so that the front side 336 of the fiber block body 312 is facing a water flow 200. Ties, not shown, extend through the fiber block body 312 and connect to the mesh 114 on opposing sides of the fiber block body 312. Likewise, apron ties, not shown, extend through the apron 316 and connect to the mesh 114 above the apron top side 319 and below the apron bottom side 321.

FIGS. 11-14 illustrate another fiber block system 200 and parts thereof that encompasses aspect of the present disclosure. As shown in FIG. 11, the fiber block system segment 210 of the fiber block system 200 comprises a rectangular fiber block 212 encased in a sleeve 213 that is also rectangular. The fiber block segment 210 does not compromise an apron, but instead comprises a top side 124, a bottom side 126 opposing the top side 124, a front side 136, a rear side 138 opposing the front side 136, wherein each of these sides is generally rectangular. The fiber block segment 210 also comprises a left side 130 aligned on one end and an opposing right side 128 aligned on the opposite end. The sleeve 213 comprises a mesh 114 that can be formed of natural fibers, such as coir fibers. The fiber block 210 can be comprised of compressed natural fibers, such as compressed coir fibers. In one aspect, the fiber block consists essentially of compressed coir fibers. In another aspect, the sleeve 213 and the mesh 214 consist essentially of coir fibers.

Figure 12:
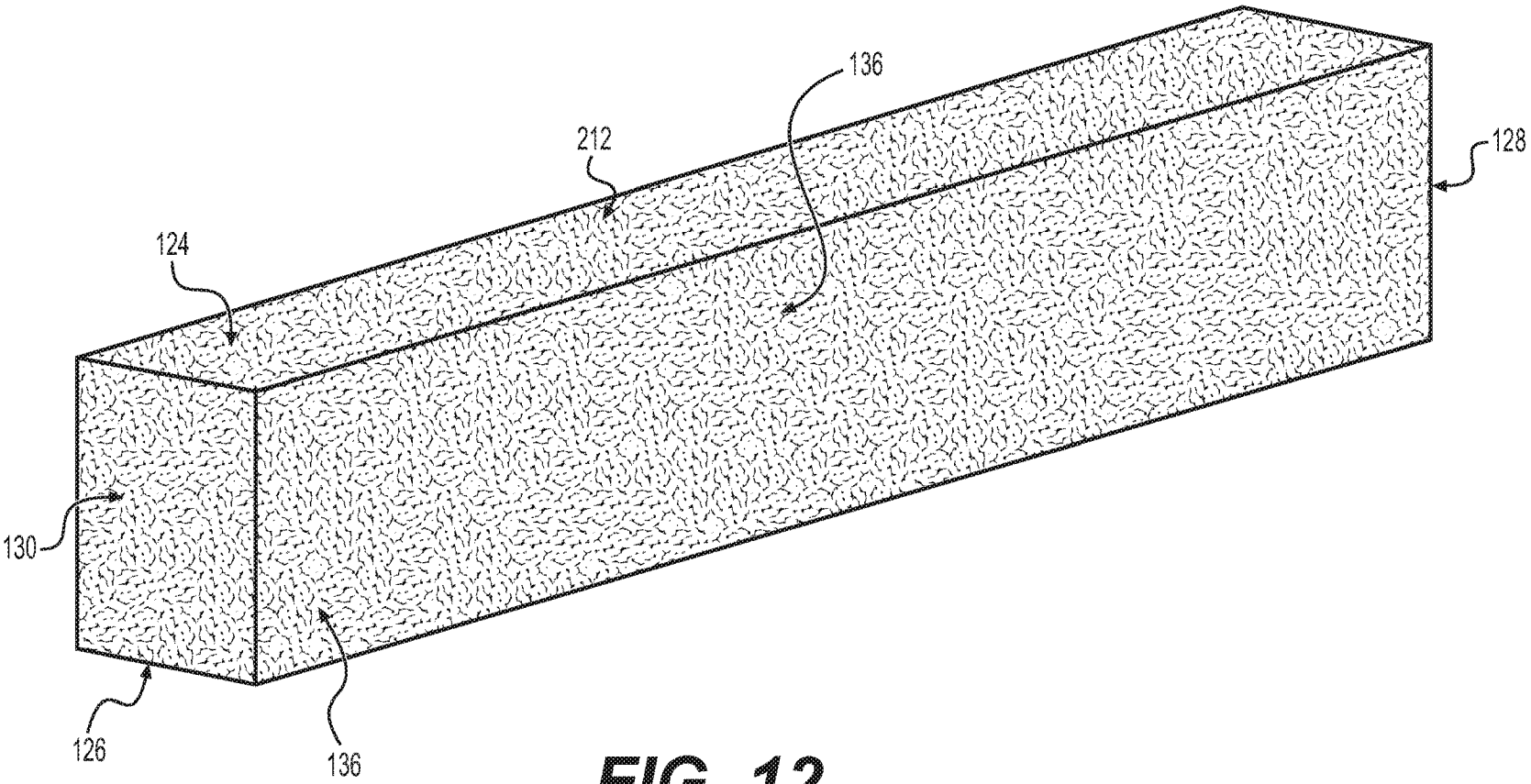
FIG. 12 is a perspective view of the fiber block of the fiber block system segment of FIG. 11 with the sleeve removed.
Figure 13:
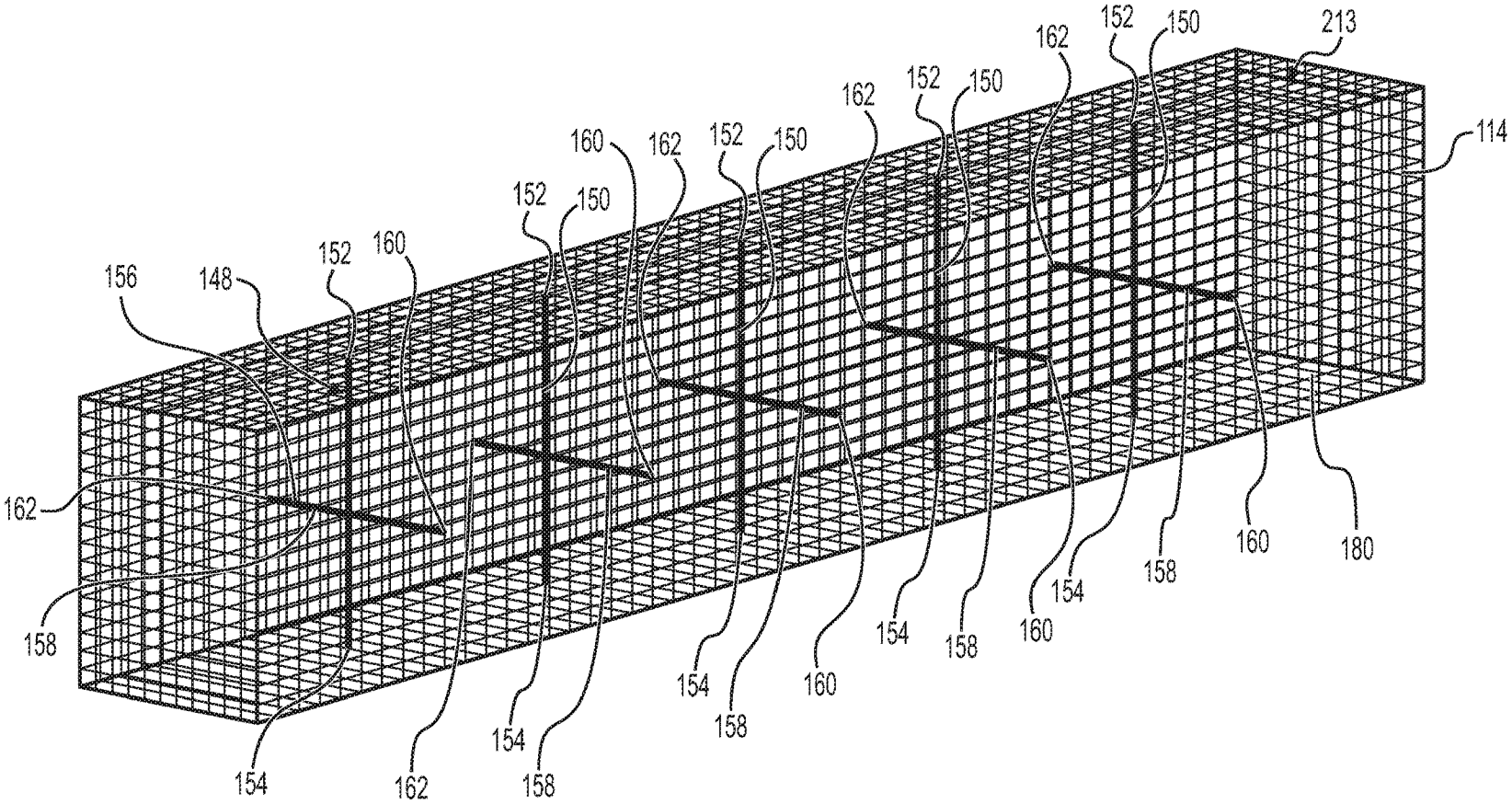
FIG. 13 is a perspective view of the sleeve of the fiber block system segment of FIG. 11 with the fiber block removed.

FIG. 12 illustrates the fiber block 212 of the fiber block system segment 210 with the sleeve 213 removed. The fiber block 212 comprises compressed coir fibers and is configured as an elongated rectangular block. FIG. 13 illustrates the sleeve 213 of the fiber block segment 210 with the fiber block 212 removed. A plurality of ties 148 is disposed in and connected to the sleeve 213. The plurality of ties 148 comprises standing ties 150 and recumbent ties 156. Each standing tie 150 can contact one of the recumbent ties 156. The sleeve 213 can be connected to other configurations of standing ties 150 and recumbent ties 156 such as those shown in FIGS. 7 and 8. Each of the standing ties 150 and recumbent ties 156 extend through the fiber block 212 and project from opposing sides thereof so as to connect to the sleeve 213. The mesh 114 of the sleeve 213 forms four rectangular sides and two rectangular ends.

As shown in FIG. 14, the fiber block system 200 can comprise a first set of stakes 142 aligned adjacent the rear side 138 of the fiber block segment 210 and a second set of stakes 142 aligned adjacent the front side 136 when installed on a ground surface. The two sets of stakes 142 cooperate with the fiber block segment 210 to maintain the alignment of the fiber block segment 210 in its original installed position during use. Staples 170 can be inserted through the fiber block 212 and also into the surface of the soil on which the fiber block system segment 210 is installed in order to assist in securing the fiber block system segment 210 in place.

As shown in FIG. 15, the fiber block system 200 can comprise an alternatively configured stake 142. A first set of stakes 142 is aligned adjacent the rear side 138 of the fiber block segment 210 and a second set of stakes 142 is aligned adjacent the front side 136, wherein one or more of the stakes 142 comprises a notch 144 formed therein that receives an anchor tie 146 looped therein. Each anchor tie 146 is attached to the sleeve 213 and can be attached to the top side 124 of the fiber block 212. Each anchor tie 146 can be securely cinched through the notch 144 of the stake 142 to which the anchor tie 146 is engaged so as to apply pressure to the top side 124 of the fiber block 212, thereby securing the fiber block system segment 210 in place after installation.

FIG. 16 illustrates the fiber block system 200 shown in FIG. 14 installed in a trench dug into the soil surface. The fiber block system segment 210 is anchored in position by the first and second sets of stakes 142 aligned on the rear and front sides 138 and 136 thereof. Staples 170 are inserted through the fiber block 212 and into the soil surface to provide additional anchor points. The trench is approximately the width of the fiber block segment 210 and deep enough to provide abutting surfaces to the front side 136 and rear side 138 of the fiber block segment 210 so as to secure the fiber block system segment 200 in place. The trench is shallow enough to allow a majority of the height of the fiber block system segment 210 to project upward above the surface of the soil so as to provide a barrier of sufficient height to block the movement of soil contained within water flows moving along the soil surface and that might flow into the fiber block 212

FIG. 17 illustrates the fiber block system 200 shown in FIG. 15 aligned in a trench formed in the surface of soil. A first set of stakes 142 is aligned adjacent the rear side 138 of the fiber block system segment 210 and a second set of stakes 142 is aligned adjacent the first side 136 of the fiber block system segment 210. Each stake 142 comprises a notch 144 formed therein through which an anchor tie 146 is secured. The anchor ties 146 are attached to the sleeve 213 along the top side of the fiber block 212 and can be tightly drawn to apply downward force to the top side of the fiber block segment 210 so as to provide additional anchoring forces to keep the fiber block segment 210 in place after installation. Staples 170 are inserted through both the fiber block 212 and the soil surface to provide additional anchoring points to secure the fiber block system segment 210.

The fiber block system 100 can be constructed by feeding loose coir fibers into a form that is shaped like the fiber block 112 and apron 116 and then compressed to cause the coir fibers to bind together and maintain the shape of the form thereby forming the fiber block 112 and the apron 116. An open end of the sleeve 113 can receive the fiber block 112 and apron 116 therein thereby allowing the sleeve 113 to be slide over the fiber block 112 and apron 116. The sleeve 113 can then be tighten around the fiber block 112 and the apron 116 and stitched above and through the apron 116 and at the left and right sides 130 and 128 of the fiber block 112 to completely encase the fiber block 112 and the apron 116. Standing ties 150 and recumbent ties 158 can be threaded through the fiber block 112 so that each tie 150 and 158 projects outward from two opposing sides of fiber block 112 and then the opposing ends of each tie can be connected to the sleeve 113 on opposing sides of the fiber block 112. The fiber block systems 200 and 300 can be constructed using similar steps.

The fiber block systems 100, 200, and 300 each can be installed as illustrated and used in erosion control sediment control, perimeter sediment control, slope length shortening, and/or check dam formation applications. The fiber block systems 100, 200, and 300 can be installed and aligned so as to form a barrier to existing or potential water flows that may contain sediment or other solids. The fiber block systems 100, 200, and 300 can act to remove or reduce the amount of sediment and other solids within the water flows so as to reduce the extent of possible erosion or introduction of the solids into a body of water.

The various alignments of the ties within the fiber block system segments disclosed herein can be combined in alternative arrangements of fiber block systems encompassed by the present disclosure. Other embodiments of the present disclosure will be apparent to those skilled in the art from their consideration of the specification and practice of the present disclosure disclosed in this document. The applicant intends that the specification and examples be considered as exemplary only, with the true scope and spirit of the present disclosure being indicated by the following claims.

The invention claimed is:

1. A fiber block system for perimeter sediment control, slope length shortening, and check dam applications comprising:

a fiber block comprising a top side, a bottom side opposing the top side, a front side connected to the top side, a rear side opposing the front side and extending between the top side and the bottom side, a right side, and a left side opposing the right side, wherein the fiber block comprises compressed natural fibers;

a sleeve encasing the fiber block, wherein the sleeve comprises a natural fiber mesh; and, a plurality of ties extending through the fiber block, wherein each tie of the plurality of ties comprises a first end extending through one of the top side, the bottom side, the front side, and the rear side of the fiber block and a second end extending through another of the top side, the bottom side, the front side, and the rear side of the fiber block, wherein each tie of the plurality of ties connects to the sleeve at the first end and the second end of the tie, whereby the plurality of ties supports the fiber block, wherein each tie of the plurality of ties comprises natural fibers, wherein the plurality of ties comprises a standing tie extending through the top side and the bottom side of the fiber block and connected to the sleeve, wherein the plurality of ties comprises a recumbent tie extending through the front side and the rear side of the fiber block and connected to the sleeve, and wherein the standing tie contacts the recumbent tie to form a planar group.

2. The fiber block system of claim 1, further comprising an apron projecting outward from the front side of the fiber block, wherein the apron comprises an apron body comprising compressed natural fibers.

3. The fiber block system of claim 2, wherein the apron body comprises an apron top side and an apron bottom side, and wherein the apron top side is aligned oblique to the apron bottom side.

4. The fiber block system of claim 2, wherein the fiber block is integrally formed with the apron body.

5. The fiber block system of claim 2, wherein the apron body comprises an apron top side and an apron bottom side, and wherein the apron top side is aligned parallel to the apron bottom side.

6. The fiber block system of claim 2, further comprising an apron tie extending through the apron body, wherein the apron body comprises an apron top side and an apron bottom side, wherein the apron tie extends from the apron top side and the apron bottom side, and wherein the apron tie connects to the sleeve above the apron top side and below the apron bottom side.

7. The fiber block system of claim 1, wherein the compressed natural fibers comprise coir fibers.

8. The fiber block system of claim 1, wherein a ratio of a rear side height of the fiber block to a top side width of the fiber block is greater than 2:1.

9. The fiber block system of claim 1, further comprising an anchor tie attached to the sleeve.

10. The fiber block system of claim 9, further comprising a stake engaged with the anchor tie and aligned adjacent the fiber block.

11. A fiber block system for perimeter sediment control, slope length shortening, and check dam applications comprising:

a fiber block comprising a top side, a bottom side opposing the top side, a front side connected to the top side, a rear side opposing the front side and extending between and connected to the top side and the bottom side, a right side, and a left side opposing the right side, wherein the fiber block comprises compressed coir fibers;

a sleeve encasing the fiber block, wherein sleeve comprises a mesh comprising coir fibers; and, a plurality of ties extending through the fiber block, wherein each tie of the plurality of ties extends through two opposing sides of the top side, the bottom side, the front side, the rear side, the left side, and the right side of the fiber block and is connected to the sleeve adjacent each of the two opposing sides through which the tie extends, whereby the plurality of ties supports the fiber block, wherein each tie of the plurality of ties comprises coir fibers, wherein the plurality of ties comprises a standing tie extending through the top side and the bottom side of the fiber block and connected to the sleeve, wherein the plurality of ties comprises a recumbent tie extending through the front side and the rear side of the fiber block and connected to the sleeve, and wherein the standing tie contacts the recumbent tie to form a planar group.

12. The fiber block system of claim 11, further comprising an apron projecting outward from the front side of the fiber block, wherein the apron comprises an apron body comprising an apron top side and an apron bottom side opposed to the apron top side, wherein the apron top side is connected to the front side of the fiber block, wherein the apron body is integrally formed with the fiber block, and wherein the apron body is encased in the sleeve and comprises compressed coir fibers.

13. The fiber block system of claim 12, wherein the apron top side is aligned parallel to the apron bottom side.

14. The fiber block system of claim 12, wherein the apron top side is aligned oblique to the apron bottom side.

15. The fiber block system of claim 12, further comprising an apron tie, wherein the apron tie extends from the apron top side and the apron bottom side, and wherein the apron tie connects to the sleeve above the apron top side and below the apron bottom side.

16. The fiber block system of claim 11, wherein the plurality of ties comprises a standing tie extending through the top side and the bottom side of the fiber block and connected to the sleeve.

17. A fiber block system for perimeter sediment control, slope length shortening, and check dam applications comprising:

a fiber block comprising a top side, a bottom side opposing the top side, a front side connected to the top side, a rear side opposing the front side and extending between and connected to the top side and the bottom side, a right side, and a left side opposing the right side, wherein the fiber block comprises compressed coir fibers;

a sleeve encasing the fiber block, wherein the sleeve comprises a coir fiber mesh; and, a plurality of ties extending through the fiber block, wherein the plurality of ties comprises a standing tie extending through the top side and the bottom side of the fiber block, wherein the standing tie is connected to the sleeve adjacent the top side and the bottom side of the fiber block, wherein the plurality of ties comprises a recumbent tie extending through the front side and the rear side of the fiber block, wherein the recumbent tie is connected to the sleeve adjacent the front side and the rear side of the fiber block, wherein the standing tie contacts the recumbent tie to form a planar group, whereby the plurality of ties supports the fiber block, and wherein each standing tie and each recumbent tie comprises coir fibers.

18. The fiber block system of claim 17, further comprising an apron projecting outward from the front side of the fiber block, wherein the apron comprises an apron body comprising an apron top side and an apron bottom side opposed to the apron top side, wherein the apron top side is connected to the front side of the fiber block, wherein the fiber block is integrally formed with the apron body, and wherein the apron body comprises compressed coir fibers.

19. The fiber block system of claim 18, further comprising an apron tie comprising coir fibers, wherein the apron tie extends from the apron top side and the apron bottom side, and wherein the apron tie connects to the sleeve adjacent the apron top side and the apron bottom side.

* * * * *